United States Patent [19]

Niese et al.

[11] Patent Number: 4,831,806

[45] Date of Patent: May 23, 1989

[54] FREE FLOATING FLOOR SYSTEM

[75] Inventors: Michael W. Niese; James H. Stoehr, both of Cincinnati, Ohio

[73] Assignee: Robbins, Inc., Cincinnati, Ohio

[21] Appl. No.: 162,088

[22] Filed: Feb. 29, 1988

[51] Int. Cl.[4] ..... E04F 13/08

[52] U.S. Cl. ..... 52/391; 52/410; 52/747

[58] Field of Search ..... 52/372, 375, 376, 377, 52/391, 393, 480, 410, 747

[56] References Cited

U.S. PATENT DOCUMENTS

| | | |
|---|---|---|
| Re. 18,573 | 8/1932 | Kocher . |
| Re. 26,239 | 7/1967 | Rockabrand et al. . |
| 174,261 | 2/1876 | Kuhn . |
| 392,810 | 11/1888 | Kelley . |
| 890,436 | 6/1908 | Momberg . |
| 968,512 | 8/1910 | Praray . |
| 975,923 | 11/1910 | Praray . |
| 1,407,679 | 2/1922 | Ruthrauff . |
| 1,587,355 | 6/1926 | Raun . |
| 1,675,226 | 6/1928 | Munroe et al. . |
| 1,752,583 | 4/1930 | Wright . |
| 1,781,117 | 11/1930 | Mackie et al. . |
| 1,940,377 | 12/1933 | Storm . |
| 2,004,917 | 6/1935 | Johnson . |
| 2,008,244 | 7/1935 | Crooks . |
| 2,046,593 | 7/1936 | Urbain . |
| 2,085,215 | 6/1937 | Gonzalez . |
| 2,092,694 | 9/1937 | Crooks . |
| 2,111,528 | 3/1938 | Cherry . |
| 2,116,737 | 5/1938 | Urbain . |
| 2,119,804 | 6/1938 | Crooks . |
| 2,151,505 | 3/1939 | Elmendorf . |
| 2,167,835 | 8/1939 | Greulich . |
| 2,227,878 | 1/1941 | Crooks . |
| 2,263,895 | 11/1941 | Larsen . |
| 2,316,671 | 4/1948 | Crooks . |
| 2,391,250 | 12/1945 | Legowik . |
| 2,554,657 | 5/1951 | Betterton et al. . |
| 2,743,487 | 5/1956 | Kuhlman . |
| 2,807,057 | 9/1957 | Mondry . |
| 2,823,427 | 2/1958 | Kuhlman . |
| 2,862,255 | 12/1958 | Nelson . |
| 2,882,560 | 4/1959 | Plendl . |
| 3,026,578 | 3/1962 | Hundley . |
| 3,031,725 | 5/1962 | Omholt . |
| 3,045,294 | 7/1962 | Livezey, Jr. . |
| 3,267,630 | 8/1966 | Omholt . |
| 3,270,475 | 9/1966 | Kodaras . |
| 3,271,916 | 9/1966 | Omholt . |
| 3,310,919 | 3/1967 | Bue et al. . |
| 3,387,422 | 6/1968 | Wanzer . |
| 3,473,281 | 10/1969 | Omholt . |
| 3,518,800 | 7/1970 | Tank . |
| 3,553,919 | 1/1971 | Omholt . |
| 3,566,569 | 3/1971 | Coke et al. . |
| 3,577,694 | 5/1971 | Omholt . |
| 3,596,422 | 8/1971 | Boettcher . |
| 3,604,173 | 9/1971 | Dahlborg . |
| 3,619,963 | 11/1971 | Omholt . |
| 3,713,264 | 1/1973 | Morgan, Jr. . |
| 3,946,529 | 3/1976 | Chevaux . |
| 4,085,557 | 4/1978 | Tharp . |
| 4,087,948 | 5/1978 | Mellor . |
| 4,090,338 | 5/1978 | Bourgade . |
| 4,170,859 | 10/1979 | Counihan . |
| 4,184,304 | 1/1980 | Merchant . |
| 4,441,293 | 4/1984 | McQueen et al. . |
| 4,443,989 | 4/1984 | Silvey et al. . |
| 4,449,342 | 5/1984 | Abendroth . |
| 4,589,243 | 5/1986 | Abendroth . |
| 4,644,720 | 2/1987 | Schneider . |
| 4,676,036 | 6/1987 | Bessert . |
| 4,685,259 | 8/1987 | Eberhart et al. . |
| 4,694,627 | 9/1987 | Omholt . |
| 4,759,164 | 7/1988 | Abendroth et al. . |

FOREIGN PATENT DOCUMENTS

| | | |
|---|---|---|
| 2103383 | 1/1971 | Fed. Rep. of Germany . |
| 998158 | 1/1952 | France . |
| 359883 | 11/1938 | Italy . |
| 280400 | 6/1927 | United Kingdom . |

*Primary Examiner*—David A. Scherbel
*Assistant Examiner*—Jerry Johnson
*Attorney, Agent, or Firm*—Wood, Herron & Evans

[57] ABSTRACT

A free floating hard wood floor system has upper and lower subfloors sandwiched to provide a monolithic panel system which supports the floorboards with optimum rigidity and integrity at a reduced cost. The upper subfloor has grooves milled in the bottom surface with flat clinching strips received within the grooves. The floorboards are disposed above the upper subfloor and secured thereto by a plurality of clinching nails extending through the florboards, the upper subfloor and into the upper subfloor after deflecting on said clinching strips.

18 Claims, 2 Drawing Sheets

FREE FLOATING FLOOR SYSTEM

FIELD OF THE INVENTION

This invention relates to a hard wood floor system and more particularly to a monolithic-like, free floating hard wood floor system.

BACKGROUND OF THE INVENTION

Hard wood floor systems are used for a variety of purposes, most notably in indoor athletic facilities, such as gymnasiums, to provide a playing surface for basketball, or racquetball for example. For athletic activities in particular, wooden floors are generally preferred over other playing surfaces because wood wears slowly and uniformly, provides high abrasion resistance and uniform resilience with only modest maintenance costs.

A typical wooden floor system is laid on a base such as a concrete or asphalt slab, or a preexisting floor. An intermediate support means or layer is secured to the base and a top layer is secured to the support surface and forms the actual playing surface. A layer of filler made of a foam or cushion material may reside between the base and the intermediate support layer or between the top layer and the intermediate layer. The top playing surface generally comprises a plurality of parallel rows of hard wood maple floorboards laid end to end and secured to the underlying support layer by nails. The thickness of the floorboards is usually a standard 25/32 of an inch, or 33/32 of an inch. The width of the floorboards is also standard, typically either $1\frac{1}{2}''$ or $2\frac{1}{4}''$ wide. Preferably, the floorboards in each row are staggered with respect to those in adjacent rows, for reasons which will be discussed later. Also, the relative vertical relationship between adjacent rows of floorboards is maintained by providing a tongue on one side and a mating groove on the other side of each floorboard. The floorboard tongues from one row reside within the floorboard grooves of the adjacent row.

The support means for a hard wood floor system is of critical importance. Such support layer must retain the individual floorboards in a set position. Wood floor systems undergo expansion due to ontake of moisture by the wood, either by direct application or from humidity. The relatively long, thin floorboards of a hard wood floor system are particularly susceptible to such expansion. Expansion of one floorboard will exert horizontal forces upon adjacent floorboards and result in displacement and/or warping.

Typically, to provide resiliency, the support layer is made of wood, sleepers or other wood based devices. However, these substances are also susceptible to expansion from moisture and/or warping. Expansion of floorboards and/or the support means can buckle or vertically displace top portions of the floor, or even cause the securing nails to be pulled out. Moreover, if the support layer is secured to the base, expansion forces will have adverse effects on the securement means. To alleviate these problems, hard wood floor systems have already been designed to float freely over the substrate with no mechanical attachment.

There are currently at least three types of free floating floor systems. These include a sleeper type, a single layer panel type with embedded nailing strips and a double-layer panel type.

A sleeper type system utilizes lengths of wood laid end to end in parallel rows in a direction which is perpendicular to the desired longitudinal direction of the floorboards. Typcially, each sleeper is 4 feet long, $2\frac{1}{2}''$ wide and $1\frac{1}{2}''$ thick. The individual sleepers are staggered with respect to the sleepers in adjacent rows, and the sleeper rows are generally spaced on 12" centers.

Each individual floorboard is secured to the underlying, intersecting sleepers by driving nails diagonally through the side of the floorboard and into the sleeper below. Thus, no portion of the securing nails is exposed on the top of the playing surface.

The sleepers may not be secured to the base, thus providing a free-floating floor. While the sleepers themselves provide substantial resistance to floor buckling, there is still the possibility of sleeper warpage and resultant floor buckling. Moreover, such sleeper systems do involve a minimum necessary base to floor surface dimensions, due to the thickness of the sleepers. Where such a floor is to be installed over a preexisting floor, the actual floor surface may be several inches higher than the original floor, especially in older gymnasiums. This could result in extensive and expensive building modifications involving door heights, threshold treatment, basket or other equipment height adjustment and the like.

Another type of free floating floor system is commonly referred to as a panel system. In a panel system, the support layer provides an intermediate layer of wood between the playing surface and the base. The intermediate layer generally comprises a plurality of rows of panels laid end to end to cover the entire surface area of the base.

Such a panel system does not have the voids defined between the sleeper rows of a sleeper system. In a panel system, the floorboards are uniformly supported beneath the entire surface area. A panel floor system is better able to support a high point load, as compared to the sleeper system. Support for a high point load is necessary to accommodate bleachers or lift trucks, or any other heavy object which must be used to bear upon a relatively small portion of the top surface of the floor. Overall, the panel system provides equal dimensional stability in all directions.

A typical panel support system comprises a plurality of $4' \times 4'$ or $4' \times 8'$ panels, having an overall thickness of $1\frac{1}{8}''$, laid end to end in parallel rows above the base. The panels typically have parallel rows of grooves milled in the top surface and aligned with the grooves of adjacent panels. Securing strips reside in these grooves and are secured to the panel below, typically by some type of vertically directed fastener mechanism, or in some cases by adhesive. The floorboards are laid over the panels, perpendicular to the grooves, and secured to the securing strips with nails. Typically, the securing strips comprise a metal channel filled with a wood strip, or a wood strip disposed between upper and lower metal plates. The nails are driven diagonally through the floorboards, into the strip to strike the metal base of the securing strip at the channel bottom surface and eventually curl toward the floorboard within the channel, to be clinched in place. Some securing strips provide a thin, nail-penetratable metal layer above the wood. Floor holding nails extend through the upper metal strip into the wood nail holding strip.

Such panel systems have proved advantageous in providing dimensional stability for a free floating floor system. However, the wooden securing strips are susceptible to splitting both when the nails are inserted and through normal wear of the floor system. Moreover, use of a plurality of modular panels of this type results in a plurality of independent subfloors, with each subfloor susceptible to warping and/or tension caused by expansion of adjacent subfloors.

Although the tongue and groove relationship between adjacently lying floorboards prevents relative vertical displacement of adjacent rows of floorboards, the tongue and groove does not prevent a whole series of floorboards from being displaced vertically. Failure of the mechanical fasteners used to secure a strip to a respective panel would allow the strip, and all the floorboards attached thereto, to be displaced in an upward direction, away from the base. Once the fastening means have failed, but for the weight of the floorboards, there is nothing to restrain upward motion of the securing strip caused by expansion forces.

Another disadvantage results from the fact that, after the floorboards have been secured to the strips residing underneath, there is no way of testing or monitoring the wear and tear of the fasteners. If any of the fasteners should fail, such failure would not be discovered until after the floorboards have already warped, at a time when it is too late to correct the problem.

A further disadvantage of a panel floor system is of an economic nature. Panels of wood having dimensions of 4'×4' or 4'×8' with a thickness of 1⅛" must be bought, grooved, and shipped from the manufacturer to the location where the floor is to be installed, increasing cost.

Another type of free floating floor system is commonly referred to as a double layer panel type. In a double layer panel system, the maple floorboards are secured to an upper subfloor of panels which is disposed over, and preferably secured to, a lower subfloor of panels. The floorboards are secured by securing nails which are driven therethrough and into the subfloor.

Although the double panel system overcomes some of the problems associated with the single panel system, the double panel system does not provide the advantages afforded by clinching the nails into the securing strips. Moreover, if a double panel system were adpated to utilize securing strips, in order to clinch the nails, the disadvantage of the securing strips per se, i.e., the tendency of the strip to split, would simply be incorporated into the floor system.

In some cases, it is desirable to insulate the floor system from a room which is located below. For example, a school might have a library located beneath a gymnasium. This can be done with acoustic matter or padding disposed below the panels. In order cases, it is desirable to make the floor more resilient. This can be done by providing a layer of close cell synthetic material beneath the panels.

In either case, the desire to insulate or make more resilient comes at the expense of the performance life of the new floor. By placing the insulating or resilient material beneath the panels, the floor is made more flexible, which is desirable. However, flexing of the floorboards tends to pull on or loosen some of the securing nails, which in turn can cause loosening or even movement of the floorboards. In some cases, the resulting differential movement of the floorboards causes the floor system to squeak or buckle during use.

It is therefore one objective of the invention to provide an improved free-floating floor, of minimal thickness and having positive floorboard securement without requiring securing strips.

A further objective of the invention has been to provide an improved free-floating, less expensive floor.

Another object of this invention is to provide a free floating panel floor system which is not susceptible to vertical displacement of adjacent floorboards or subfloor modules resulting from raising of a securing strip.

It is a still further object of this invention to provide a free floating panel floor system which individual panels are less susceptible to horizontal expansion forces caused by adjacent panels.

It is still another object of this invention to provide a free floating panel floor system which is both lower in purchase price and less expensive to ship, as compared to current systems.

It is still another object of this invention to provide a system which is long lasting, having increased resiliency without premature fastener pullout.

SUMMARY OF THE INVENTION

To these ends, a preferred embodiment of the invention includes a monolithic-like free floating panel floor system having upper and lower overlapping subfloor panels with a plurality of parallel grooves milled in the bottom surface of the upper panels, and a flat nail clinching strip disposed within each groove. A plurality of floorboards are disposed above the upper subfloor panels, perpendicular to the clinching strips. The floorboards are secured to the upper subfloor panels above the clinching strips by clinching nails driven through the floorboards and into the upper subfloor, whereupon they engage a clinching strip and curl upwardly into the upper subfloor panel.

The use of two overlapping subfloors, adhered or fixed together in a layered or sandwiched configuration, with the upper subfloor disposed above and secured to the lower subfloor so that all of the joints of the bottom subfloor are lapped, results in a monolithic-like floor system which provides stability against horizontal expansion forces. As opposed to prior modular panel systems, each panel in a monolithic system is restrained because it is secured to three or more other such panels on a top or bottom surface thereof. Overlapping adhered panel layers are less likely to expand independently in a horizontal plane than one layer of modular panels. Thus, the overlapped subfloors provide a floor system which is exceedingly high in resistance to buckling. Although not critical, the upper subfloor panels and the lower subfloor panels are preferably disposed at an angle ranging from about 45° to about 135°.

By locating the milling grooves and the clinching strips at the bottom surface of the upper subfloor, both the clinching strips and the floorboards secured thereto are physically restrained from being displaced vertically, and do not rely upon mechanical attachment means between the clinching strips and the subfloor. The floor nails hold the floorboards directly to the upper subfloor panel; not to any strip or other device. In other words, this panel system eliminates both the need to mechanically fasten securing strips and the damage caused by failure of such mechanical fastening means.

Use of two thinner subfloor layers to constitute the subfloor also results in a cost savings to the end-user. Only the upper subfloor must be pre-worked to mill the grooves. The lower subfloor can be purchased by the buyer at or near the location of the floor system, thus alleviating the cost of shipping the lower subfloor from a site of manufacture to the end-user location.

Additionally, the total cost of materials for the monolithic panel system of this invention is reduced by using two layers of panels having ½" thickness as opposed to one layer of panels having a 1⅛" thickness, for example. As the thickness of a wood panel increases, the cost of fabricating increases at a rate which is disproportionately higher. For a given floor area, the cost of two ½" thick panels is less than one 1" thick panel. In other words, to achieve a desired height, it is cheaper to use a double layer of panels that have a thickness equal to half the desired height than it is to simply use one layer of panels having a thickness equal to the desired height. Thus, due to the use of two layers, even if the manufacturer must ship the entire upper and lower layers to the site, this invention produces a savings in the total cost of wood. Moreover, there is no need to construct and install a composite securing strip such as a metal channel and wood, nail-holding filler.

These and other objectives and advantages of the invention will be further appreciated from the following detailed description of a preferred embodiment thereof and from the drawings in which:

DETAILED DESCRIPTION OF A PREFERRED EMBODIMENT

Figure 1:
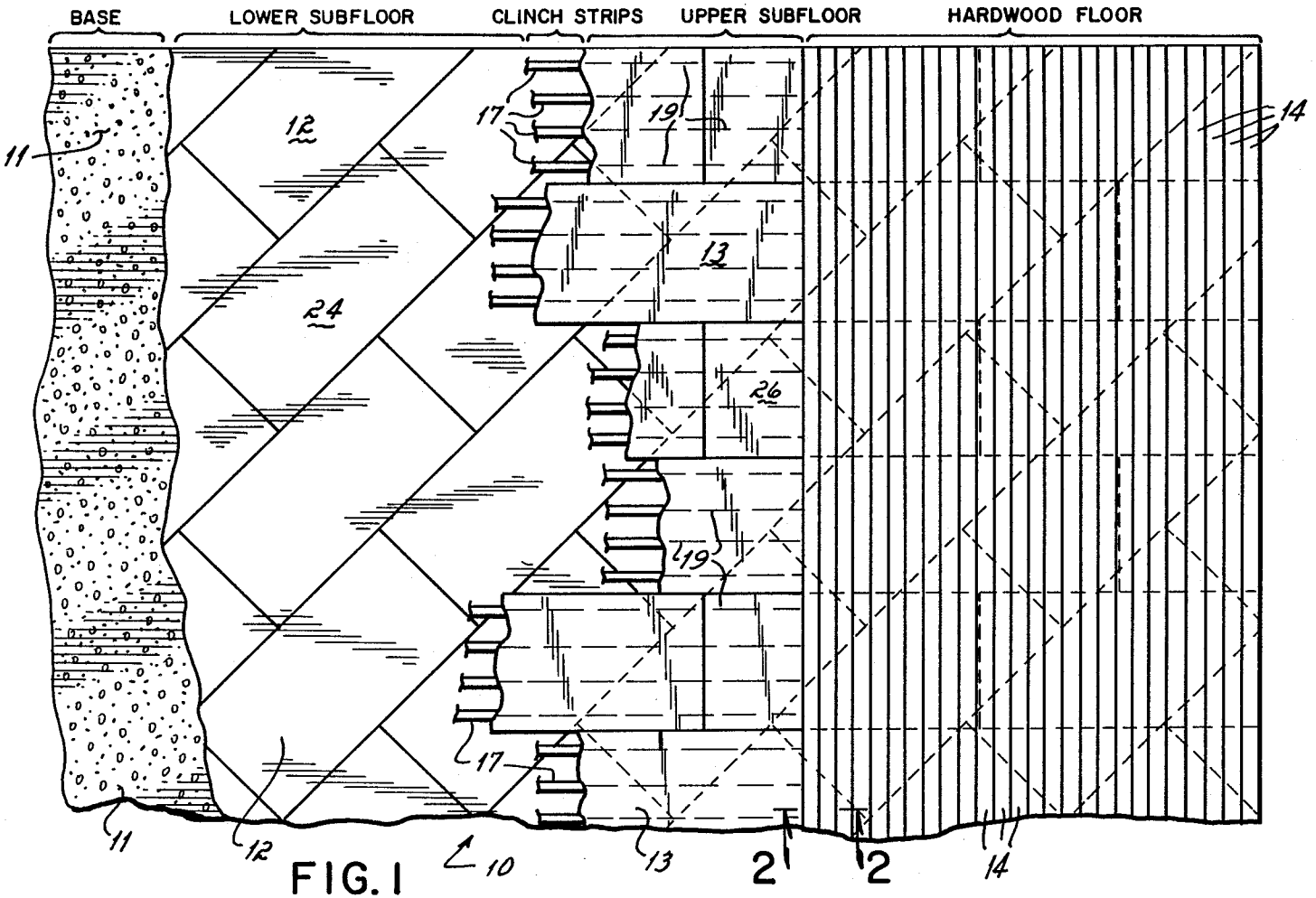
FIG. 1 is a top plan view of the free floating panel floor system of this invention, broken away to illustrate the various underlying components of the system.

A free floating panel floor system 10 of this invention is shown in FIG. 1. A base or substrate layer 11, shown at the left, is the bottommost support surface for the entire floor system 10. Typically, base 11 will be of concrete, asphalt, a pre-existing floor or other suitable base. If desired, a layer of leveling or insulating components, in the nature of a foam or cushion (not shown) may be placed immediately upon base 11. A lower subfloor layer 12 of panels is disposed upon, but not secured to, base 11, preferably at an angle of 45° with respect to the sides of the area to be floored or to the intended direction of the floorboards to be described. An upper subfloor layer 13 of panels is secured by adhesive, nails, staples or other means over the lower subfloor 12, preferably at an angle ranging from about 45° to about 135° with respect to the lower subfloor layer 12. In FIG. 1, the lower subfloor 12 is lain on a bias, and upper subfloor 13 is disposed at about a 45° angle thereto, thus overlapping all the joints of the subfloors. Parallel rows of hard wood floorboards 14 are disposed above and secured to upper subfloor 13, all as seen from left to right in FIG. 1. The system 10 is preferably free floating because there is no direct mechanical attachment between its components and base 11.

Figure 3:
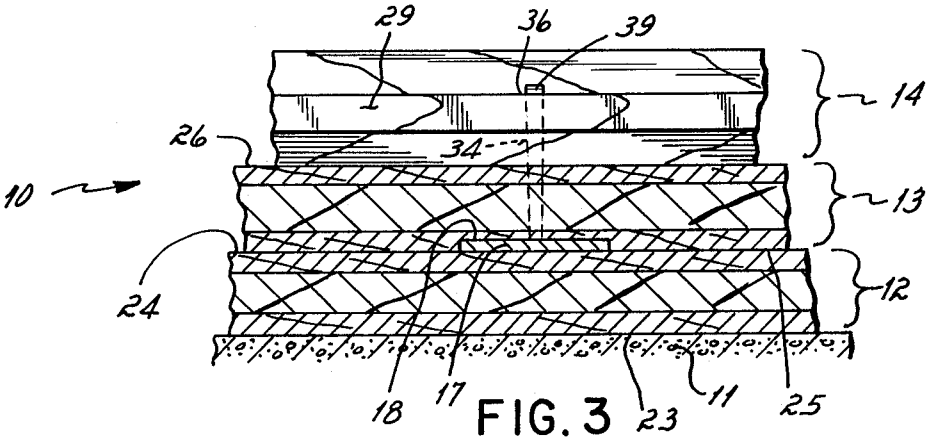
FIG. 3 is a cross sectional view taken along lines 3—3 of FIG. 2.

The upper subfloor panels are provided with a plurality of parallel grooves 18 (FIG. 3) in the lower surfaces thereof such that metal nail clinching strips 17 can be disposed therein, sandwiched between the lower subfloor panels on the lower side and groove bottoms on the higher side. The clinching strips 17 are shown in FIG. 1 extending out from the bottom of upper subfloor 13. The floorboards 14 are secured to the upper subfloor in general perpendicular disposition thereto. The grooves 18 are sized to accommodate the nail clinching strips 17, which are preferably about 22–24 gauge thick, and abut 1½"–2" wide. The upper surface of upper subfloor 13 on which floorboards 14 are laid has elongated markings 19 to indicate the position of the nail clinching strips 17.

Preferably, the lower subfloor 12 comprises a plurality of 4×8 wooden panels having a thickness of a half inch. The lower subfloor 12 panels are laid end to end in parallel rows at a preferred, predetermined angle of 45° to the predetermined floorboard disposition. Preferably, the panels in adjacent rows of panels are staggered so that no joints continue across two rows.

The panels comprising the upper subfloor 13 are also laid end to end in parallel rows, in staggered fashion. The upper subfloor 13 is disposed above the lower subfloor 12 at a preferred angle of 45°. The elongated grooves 18 run parallel with the major length of upper panels 13 and perpendicular to the predetermined longitudinal direction of the elongated floorboards 14. The grooves 18 might also run perpendicular to the longitudinal direction of the upper subfloor 13 panels, so long as the grooves 18 and the floorboards 14 intersect at right angles. Although the angle between the lower subfloor 12 and the upper subfloor 13 is not critical, it is important that all the joints of the lower subfloor 12 are overlapped by an upper panel to provide, in effect, a monolithic panel system when the panels are glued, fastened or otherwise secured together. The system is said to be monolithic because the subfloors are layered, lapped and secured. Unlike modular panel systems, in which any one panel of a plurality of independent subfloors can exert adverse horizontal forces upon adjacent panels, possibly resulting in vertical displacement, buckling of and/or warping, each panel in a monolithic system is vertically secured to, and restrained by, a number of overlying or underlying panels. This lapped, secured structure significantly reduces buckling caused by the exertion of horizontal expansion forces upon the floorboards 14.

Figure 2:
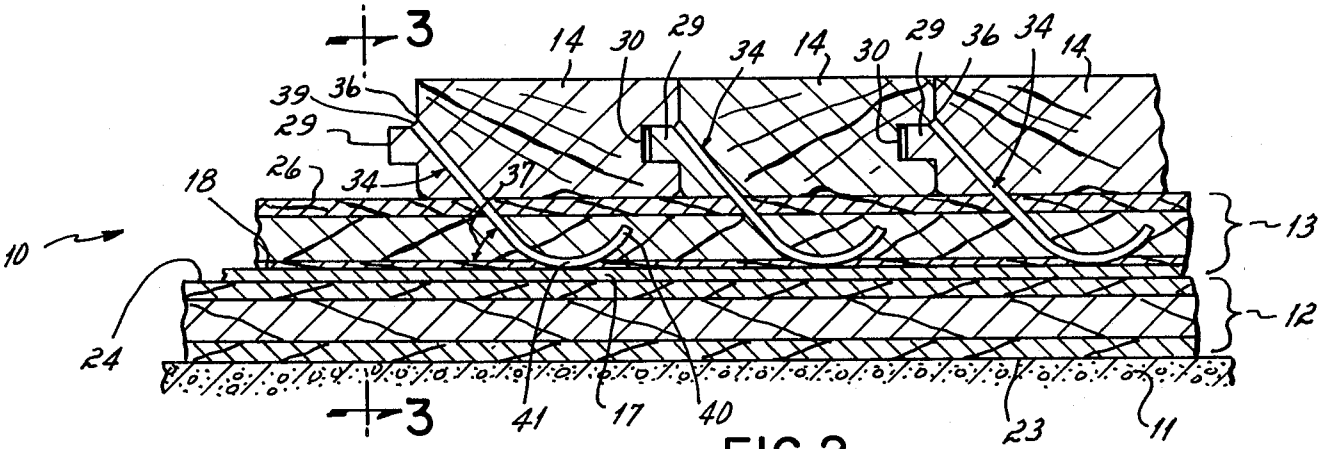
FIG. 2 is a cross sectional view taken along lines 2—2 of FIG. 1.

Lower subfloor 12 has a bottom surface 23 resting upon base 11, and a top surface 24 opposite the bottom surface 23. A bottom surface 25 of upper subfloor 13 resides upon top surface 24 of lower subfloor 12, and is secured thereto, preferably by glue (not shown). Alternately, glue can be used with suitable fasteners, or fasteners can be used alone. The floorboards 14 are disposed above a top surface 26 of upper subfloor 13. The floorboards 14 typically include a tongue 29 on one side and a mating channel or groove 30 on the opposite side, as shown in FIG. 2. With the channel 30 and the tongue 29 of adjacent rows of floorboards 14 cooperating in this manner, and the floorboards 14 secured to the upper subfloor 13, adjacent rows of floorboards 14 are prevented from relative vertical displacement.

The floorboards 14 are secured to upper subfloor 13 by a plurality of clinching nails 34. The nails 34 are preferably inserted at a position 36 located above tongue 29 and in register with indicaters 19. Nails 34 are driven at an angle with respect to the horizontally residing floor system 10, through the floorboard 14 and into the upper subfloor 13. The angle of insertion is designated by arrows 37 shown in FIG. 2. Preferably, the angle of insertion is about 53°.

As noted, each nail 34 is positioned to be inserted and driven at a marking 19 on top surface 26 which indicates the position of a clinching strip 17 below. Preferably, each nail 34 is driven downward at the aforementioned angle until it contacts a clinching strip 17 and is curled back up in subfloor 13 toward top surface 26. Each driven nail 34 has a first end 39 or top portion residing adjacent tongue 29, a second, bottom end 40 directed upwardly toward top surface 26, and an intermediate portion 41 bowed or curled away from the clinching strip 17. With the nails 34 securing the floorboards 14 directly to upper subfloor 13, and the clinching strip 17 residing beneath upper subfloor 13, restrained from vertical displacement, a free floating panel floor system of this invention provides optimum rigidity and integrity for a hard wood floor system. There are no securing strips to assemble, insert and secure.

In a method of installing the free floating panel floor system 10 of this invention, the lower subfloor 12 is laid upon the supporting surface or base 11. An upper subfloor 13 is secured to the top surface 24 of the lower subfloor 12 at an angle with respect to the lower subfloor, in order to overlap all the lower subfloor 12 joints. The upper subfloor 13 has grooves 18 milled in a bottom surface thereof and a flat clinching strip 17 is disposed within each milled groove 18. This strip insertion is preferably done at the factory where strip register with the markings 19 is assured. A plurality of floorboards 14 are disposed, one row at a time, above top surface 26 of upper subfloor 13. The floorboards 14 are secured to the upper subfloor 13 by clinching nails 34, driven through a floorboard, and the upper subfloor 13 at marking 19 to a point where it engages the clinching strip 17 and curls back into the upper surface 13, toward top surface 26.

Once installed, the floor system 10 of this invention floats freely above base 11. Its rigidity provides optimum assurance against buckling. Each panel of the lower subfloor 12 has all its joints lapped, and thus is restrained by at least a portion of several other overlying, secured panels of the upper subfloor 13. Likewise, each panel of the upper subfloor 13 is secured to several underlying panels of the lower subfloor 12. In such a monolithic system, no single panel or row of panels can expand independently of the other panels. Thus, compared to a modular panel system, a monolithic panel system significantly reduces horizontally displacement and/or buckling of the floorboards 14 or panels resulting from moisture expansion.

By placing the clinching strip 17 within a groove 18 in the bottom surface 25 of the upper subfloor 13, upward displacement of the clinching strip is prevented. Moreover, this is accomplished in a manner which eliminates both the need to mechanically fasten the strips 17, and the accompanying danger presented by failure of the mechanical attachment means, namely, vertical displacement of a whole series of adjacent floorboards 14.

The use of two subfloors to create the panel system provides a strong, buckling resistant support for a hardwood floor, yet at a reduction in the total cost of wood required to provide the panel system as compared to prior panel systems. Because the grooves 18 are milled into the bottom 25 surface of the upper subfloor 13, and no pre-installation work needs to be done on the lower subfloor 12, the lower subfloor 12 can be purchased by the buyer at or near the location of installation. The manufacturer is not required to purchase and ship the lower subfloor 12, resulting in overall reduced shipping costs for the panel system. The lowered shipping cost, made possible by this invention, further reduces the total cost of a free floating panel floor system for the end user.

In alternate embodiments of this invention, the lower subfloor layer may comprise either close cell synthetic or other cushioning material to provide increased resilience or acoustical matting or padding to provide audio insulation. In these embodiments, the upper subfloor can be secured to the lower subfloor by glue or other means, or simply disposed thereon.

Other modifications and advantages will become readily apparent to one of ordinary skill in the art, without departing from the scope of this invention, and applicant intends to be bound only by the claims appended hereto.

We claim:

1. A free floating floor system comprising:
- an upper subfloor having respective top and bottom surfaces;
- a plurality of grooves milled in said bottom surface of said upper subfloor;
- a nail clinching strip received within each of said grooves;
- a plurality of floorboards disposed above said upper subfloor; and
- a plurality of clinching nails extending through said floorboards and into said upper subfloor above said clinching strips to secure said floor boards to said upper subfloor.

2. A free floating floor system as in claim 1 wherein each said extending clinching nail has an intermediate section curling away from said clinching strips into said upper subfloor.

3. A free floating floor system as in claim 1 wherein portions of each said clinching nail in said floorboards reside at a predetermined angle with respect to said clinching strip.

4. A free floating floor system as in claim 3 wherein said predetermined angle is about 53° with respect to said clinching strip.

5. A free floating floor system as in claim 1 further including markings in the top surface of said upper subfloor in register with the location of said grooves in said bottom surface thereof.

6. A free floating floor system as in claim 1 wherein said clinching strips are metal, having a thickness ranging from about 22 to 24 gauge, said grooves milled to accommodate said strips.

7. A free floating floor system as in claim 1 wherein said grooves are spaced on centers of about 12" apart.

8. A free floating floor system comprising:
- a lower subfloor having respective top and bottom surfaces;
- an upper subfloor having respective top and bottom surfaces, with the bottom surface thereof facing the top surface of the lower subfloor;
- a plurality of grooves milled in said bottom surface of said upper subfloor;
- a nail clinching strip received within each of said grooves;
- a plurality of floorboards disposed above said upper subfloor; and
- a plurality of clinching nails extending through said floorboards and into said upper subfloor above said clinching strips to secure said floorboards to said upper subfloor.

9. A free floating floor system as in claim 8 wherein said upper subfloor is secured to said lower subfloor.

10. A free floating floor system as in claim 8 wherein said lower subfloor comprises wood panels.

11. A free floating floor system as in claim 8 wherein said lower subfloor comprises closed cell synthetic material.

12. A free floating floor system as in claim 8 wherein said lower subfloor comprises acoustical matting.

13. A method of preparing an underlayment for a free floating floor system having floorboards, an upper subfloor and a lower subfloor comprising the steps of:

milling grooves into the bottom surface of an upper subfloor;

disposing clinching strips within said grooves; and marking a top surface of the upper subfloor in register with the position of said grooves and clinching strips therein.

14. A method of installing a floor comprising the steps of:

laying a lower subfloor upon a supporting surface;

securing an upper subfloor to a top surface of said lower subfloor, said upper subfloor having grooves milled in a bottom surface thereof and having a clinching strip disposed within each of said milled grooves; and driving clinching nails through a floorboard and through said upper subfloor such that said nails engage a clinching strip and curl back into said upper subfloor to secure said floor board thereto.

15. A method of installing a floor as in claim 14 wherein said upper subfloor has markings on a top surface thereof in register with the location of said grooves, and further comprising the step of:

driving said nails through said floorboard into said upper subfloor at said markings such that said nails hit said strip and curl back into said upper subfloor.

16. A method of installing a floor as in claim 14 wherein said floorboards, said upper subfloor and said lower subfloor float freely upon a base.

17. A method of installing a floor comprising the steps of:

laying a lower subfloor upon a supporting surface;

laying an upper subfloor on a top surface of said lower subfloor, said upper subfloor having grooves milled in a bottom surface thereof and having a clinching strip disposed within each of said milled grooves; and driving clinching nails through a floorboard and through said upper subfloor such that said nails engage a clinching strip and curl back into said upper subfloor to secure said floor board thereto.

18. A method of installing a floor as in claim 17 wherein said upper subfloor comprises a plurality of panels, said lower subfloor comprises a plurality of panels, and said upper subfloor panels are secured to said lower subfloor at an angle.

* * * * *